US007753698B2

(12) United States Patent
Fisher

(10) Patent No.: US 7,753,698 B2
(45) Date of Patent: Jul. 13, 2010

(54) GROUNDING BAND FOR ELECTRICAL CONNECTORS

(75) Inventor: Jon A. Fisher, Unadilla, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/243,641

(22) Filed: Oct. 1, 2008

(65) Prior Publication Data

US 2010/0081317 A1 Apr. 1, 2010

(51) Int. Cl.
*H01R 13/648* (2006.01)

(52) U.S. Cl. ..... 439/95; 24/297

(58) Field of Classification Search ..... 439/610, 439/92–100; 24/297
See application file for complete search history.

(56) References Cited

U.S. PATENT DOCUMENTS 3,435,126 A * 3/1969 Hamilton ..... 174/89
4,237,174 A * 12/1980 Lagardere et al. ..... 428/99
4,445,733 A * 5/1984 Deel ..... 439/98
5,346,403 A * 9/1994 Hyzin ..... 439/95
5,423,695 A * 6/1995 Robinson et al. ..... 439/95
6,642,451 B1 * 11/2003 Gretz ..... 439/92
6,857,882 B2 * 2/2005 Van Den Meersschaut .... 439/95
7,112,094 B2 * 9/2006 Reilly et al. ..... 439/610

FOREIGN PATENT DOCUMENTS

| | | |
|---|---|---|
| EP | 0041420 | 12/1981 |
| EP | 0310945 | 4/1989 |
| GB | 2055513 | 3/1981 |
| GB | 2059184 | 4/1981 |
| GB | 2073503 | 10/1981 |

* cited by examiner

*Primary Examiner*—Briggitte R Hammond
(74) *Attorney, Agent, or Firm*—Blank Rome LLP

(57) ABSTRACT

A conductive band for an electrical connector that includes an elastic metal strap with first and second ends and an array of flexible members extending between the first and second ends. Each of the first and second ends has a terminal lead. A clip is coupled to the terminal leads of the first and second ends.

15 Claims, 4 Drawing Sheets

GROUNDING BAND FOR ELECTRICAL CONNECTORS

FIELD OF THE INVENTION

The present invention relates to a grounding band used with electrical connectors for both grounding and EMI shielding. More specifically, the present invention relates to a grounding band that includes a joining mechanism for holding its ends together.

BACKGROUND OF THE INVENTION

Grounding bands are typically used in electrical connector assemblies, such as plug and receptacle assemblies, to provide both grounding and EMI shielding. The grounding band fills in the gap between the electrical connectors of the assembly, such as a plug and receptacle. The grounding band maintains a conductive path between the electrical connectors.

Conventional grounding bands are formed typically by welding the ends of the strap that forms the band. More specifically, the ends of the grounding band are typically spot welded. Spot welding poses a number of problems. Welding is costly and material variations affect the precision of the weld. Spot welding requires physical contact of electrodes on both sides of the overlapped ends of the band. Due to the very small size of the spot weld region, however, small diameter electrodes with specially shaped tips are required. Also, change in the physical shape of the electrodes and the amount of foreign material on the electrode surface often have a negative impact on the weld's internal structure. Welded bands are prone to failure because of process variables and reliance on operator skill to properly align the ground strap ends during the welding operation. As the electrodes are used, each welding cycle causes additional foreign material to collect on the electrode face. This in turn changes the electrical resistance between the electrode and the objects being welded. When the resistance increases between the electrode and the workpiece, less energy is available for the intended welding of the product. Because of this change, the weld strength must be tested. That testing can only be done by destroying the band.

Moreover, although periodic cleaning of the electrodes can be done by use of an abrasive cloth, over time, that changes the shape of the electrodes requiring replacement of the electrodes. Replacement of the electrodes takes time away from production. Following the replacement, the weld must be tested resulting in more grounding band material being wasted.

Also, the conventional method of overlapping leaves at the ends of the grounding band strap significantly increases the thickness of the band at that point. Because of the limited clearance between the two mated connector elements (i.e. the plug and receptacle) and additional thickness added to the band could prevent proper mating of the connector elements. This overlapping causes a misalignment of the ends of the grounding band. This misalignment condition can cause loss of continuity between the ends of the grounding band when on a plug connector and the inner wall of a receptacle connector thus reducing the electrical path between the two connectors and the effectiveness of the EMI shielding.

SUMMARY OF THE INVENTION

Accordingly, the present invention relates to a conductive band for an electrical connector that includes an elastic metal strap with first and second ends and an array of flexible members extending between the first and second ends. Each of the first and second ends has a terminal lead. A clip is coupled to the terminal leads of the first and second ends.

The present invention also relates to a conductive band for an electrical connector that includes an elastic metal strap having first and second ends and an array of flexible members extending between the first and second ends. Each of the first and second ends has a terminal lead, and each of the terminal leads has a notch. A clip is coupled to the terminal leads of the first and second ends. The clip includes a main body and a plurality of arms extending therefrom. At least one of the arms engages at least one of the notches of the terminal leads of the elastic metal strap, whereby the terminal leads are aligned such that the notches mirror each other.

The present invention also relates to a conductive band for an electrical connector that includes an elastic metal strap with first and second ends and an array of flexible members extending between the first and second ends. Each of the first and second ends has a terminal lead. The terminal leads are aligned with one another without overlapping, and at least one of the terminal leads has a notch. A clip is coupled to the terminal leads of the first and second ends. The clip includes a main body and at least one arm extending therefrom. The at least one arm engages the notch of the at least one terminal lead of the elastic metal strap.

Other objects, advantages and salient features of the invention will become apparent from the following detailed description, which, taken in conjunction with the annexed drawings, discloses preferred embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-6 and 7A-7E, the present invention relates to an improved grounding band 100 that uses a clip 110 instead of a weld attachment. By using the clip 110 attachment, the problems of welding are avoided and it also allows for an automated process in making the bands. Also, use of the clip instead of a weld does not require overlapping of the leaf ends of the band's strap thus producing a grounding band 100 no thicker than the weld assembly allowing plug and receptacle elements to mate properly. That also avoids misalignment of the band's ends thus ensuring a continuous electrical path. Additionally, no destructive testing is required to verify the integrity the band. That is because unlike the weld process the mechanical assembly of the clip 110 is done using robotics and die tooling to create, form and assemble the clip 110. Because of the precision and tool life, the preparation and assembly of the clip on the grounding band is extremely repeatable. The tooling would be good for millions of cycles before refurbishing is required. Moreover, unlike the welded assembly which has a joint that is within the assembly and cannot be visually verified as structurally sound. The clip 110, on the other hand, can be seen and any deformities or defects can be visually inspected without product destruction.

Figure 5:
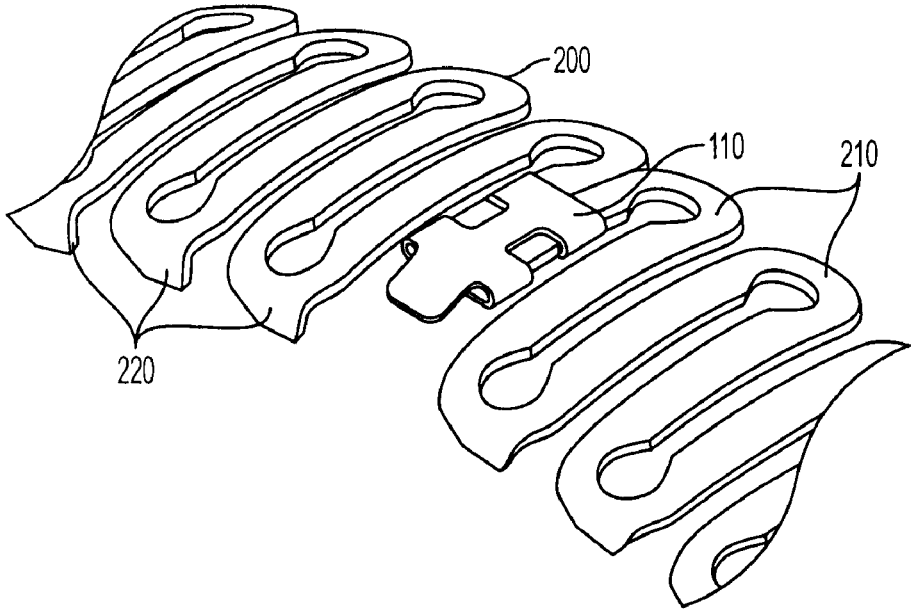
FIG. 5 is a partial perspective view of the grounding band illustrated in FIG. 1 showing the clip on the grounding band.
Figure 6:
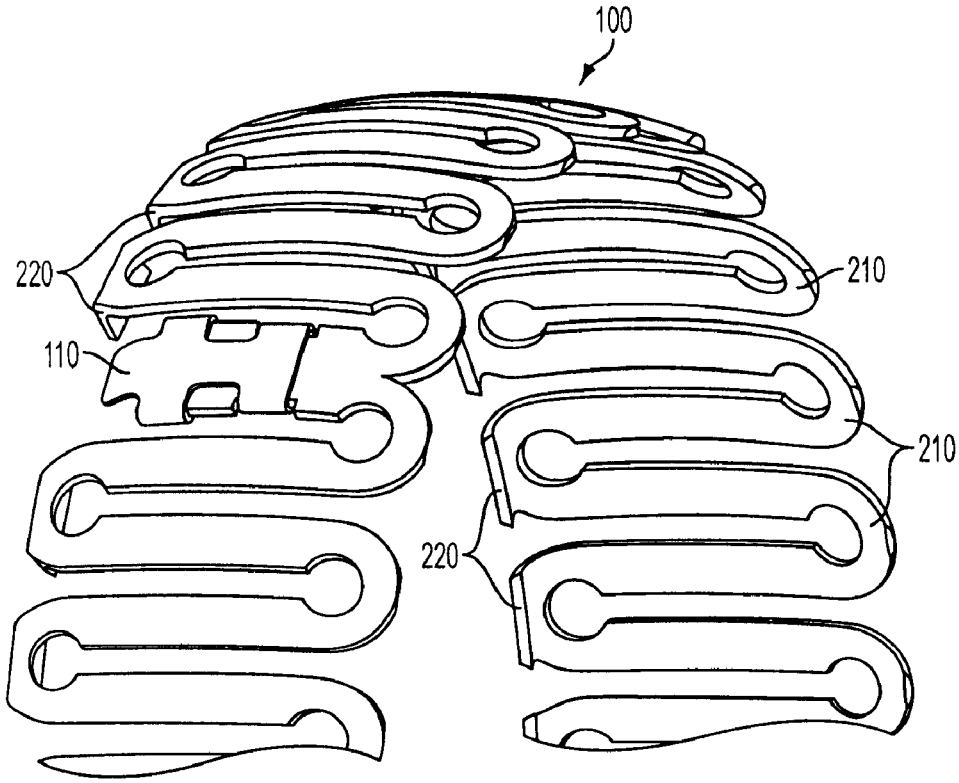
FIG. 6 is a partial perspective view of the grounding band illustrated in FIG. 1.

The grounding band 100 generally includes a metal strap 200 joined at its ends by the clip 110. The clip 110 aligns and secures the specifically prepared ends of the grounding band 100. The metal strap 200 may be formed of any conductive material, such as stainless steel. The strap 200 may include an array of flexible members 210 making the band 100 elastic. The elasticity of the strap 200 allows the strap 200 to adjust to different dimensions or tolerances of the connectors. Each flexible member 210 is preferably U-shaped, as seen in FIGS. 5 and 6. Teeth 220 may be provided that extend from one edge of the band's strap 200, as best seen in FIGS. 5 and 6. The teeth 220 extend from one end of the U-shape members 210 and curve inwardly. The teeth 220 are configured to engage a corresponding groove on an electrical connector (not shown) for locating and stabilizing the band 100 on the connector to avoid interference between the connectors when mating.

Figure 1:
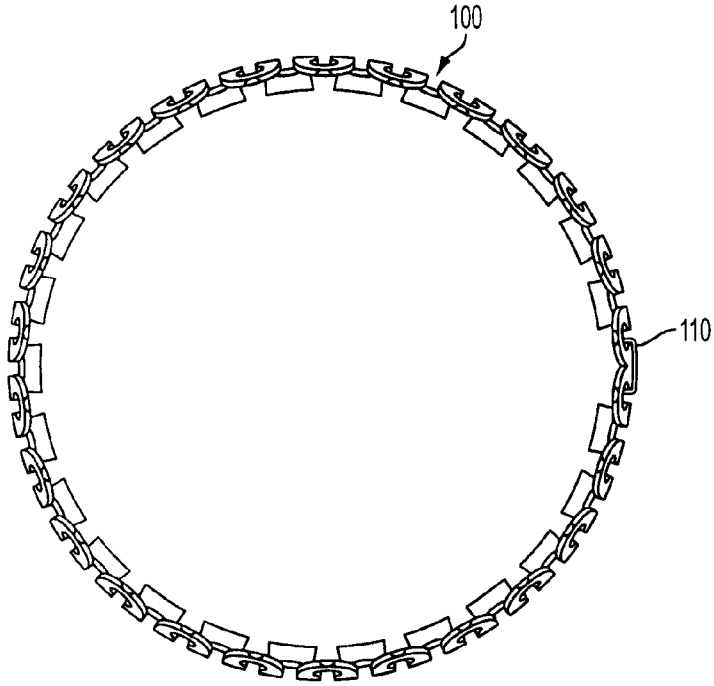
FIG. 1 is a plan view of a grounding band according to the present invention.
Figure 2:
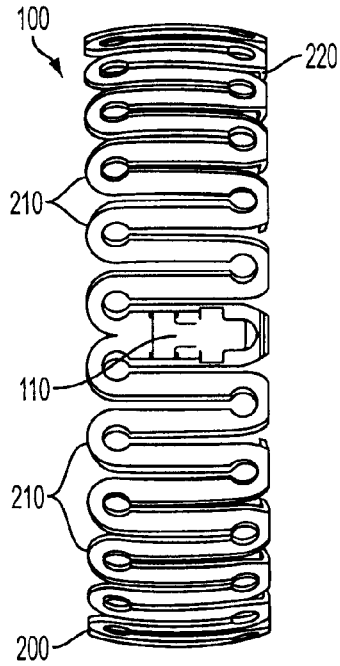
FIG. 2 is a side elevational view of the grounding band illustrated in FIG. 1; showing a joining mechanism or clip.
Figure 3:
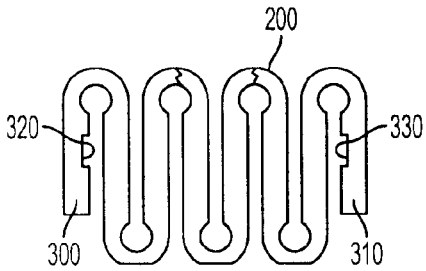
FIG. 3 is a partial side elevational view of a strap of the grounding band illustrated in FIG. 1, showing notches in the strap ends.
Figure 4:
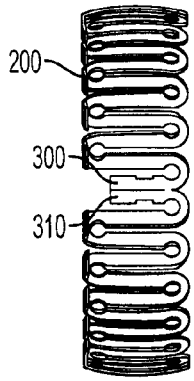
FIG. 4 is a perspective view of the grounding band illustrated in FIG. 3 without the clip.

Each end 300 and 310 (FIGS. 3 and 4) of the strap 200 of the band 100 is a terminal lead. The terminal leads at the ends 300 and 310 include corresponding notches 320 and 330 for engaging the clip 110. The ends 300 and 310 meet to form the band such that the notches 320 and 330 mirror each other (FIG. 4).

Once the ends 300 and 310 are aligned, the clip 110 may be coupled to the ends 300 and 310 such that the clip 110 engages the notches 320 and 330. The steps of making the band by meeting its ends 300 and 310 and coupling the clip 110 can be done using an automated process. The engagement of the clip 110 and the notches 320 and 330 ensures that the terminal leads of the ends 300 and 310 are properly aligned.

Figure 7A:
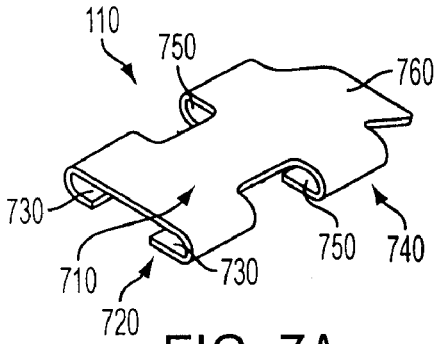
FIGS. 7A-7E illustrate the clip of the grounding band illustrated in FIG. 1.
Figure 7B:
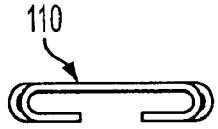
Figure 7C:
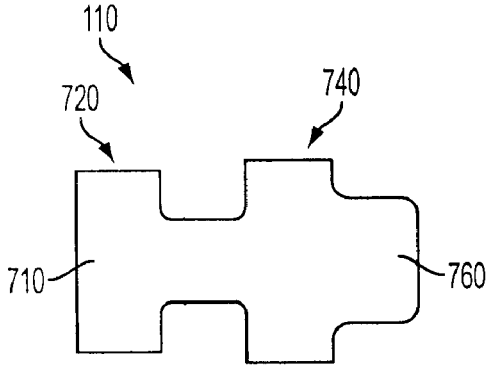
Figure 7D:
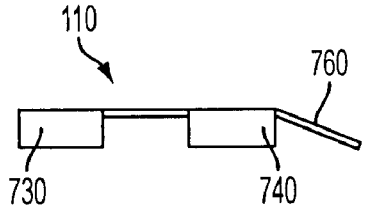
Figure 7E:
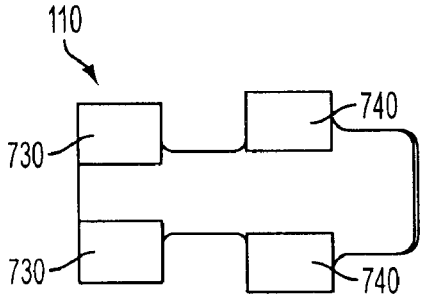

As seen in FIGS. 7A-7E, the clip 110 may include a main body 710, first and second set of arms 720 and 740, and a ramp 760. The first set of arms 720 include two arms 730 extending from opposite side edges of the main body 710 remote from the ramp 760 (FIG. 7A). The second set of arms 740 includes two arms 750 extending from the side edges of the main body 710 near the ramp 760. As seen in FIGS. 7A and 7B, the arms 730 and 750 curve inwardly with respect to the main body 710 and the band 100 (FIG. 6).

When the clip 110 is coupled to the ends 300 and 310 of the band's strap 200, the arms 730 of the clip 110 fit in the notches 320 and 330, respectively, thereby preventing misalignment of the bands' ends. The ends 300 and 310 meet and are aligned with one another (FIG. 4) and do not overlap. Therefore the thickness of the band is not increased at its ends. The arms 750 of the second set, which are preferably wider than the arms 730 of the first set (FIG. 7E) wrap around the strap ends 300 and 310 to secure the clip 110 to the strap ends. To ensure attachment of the clip 110 on the band, the clip 110, and particularly arms 720 and 740, may be clamped to the band. The ramp 760 may be provided which extends outwardly to prevent a mating connector from catching the clip when assembling the two connectors.

Figure 8A:
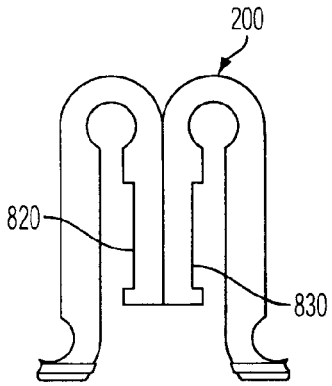
FIGS. 8A-8C illustrate a second embodiment of the clip.
Figure 8B:
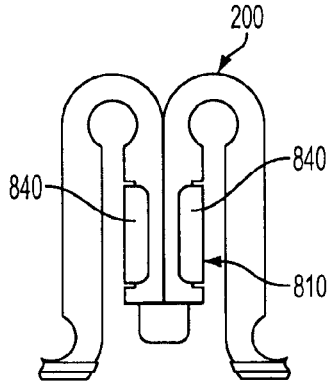
Figure 8C:
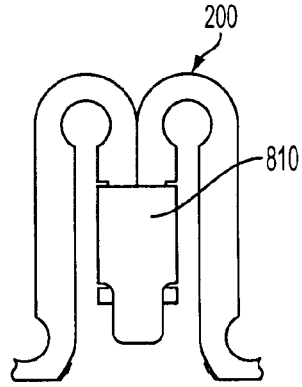

Alternative designs of the clip 110 are possible. For example, FIGS. 8A-8C illustrate another embodiment of the clip. The clip 810 of FIGS. 8A-8C is similar to clip 110 except it includes only a single tab or arm 840 (FIG. 8B) extending from each the edge of the main body of the clip 810. The tabs 840 may extend for substantially the entire length of the clip's main body. Corresponding notches 820 and 830 (FIG. 8A) are located in the terminal ends of the strap 200 which receive the arms 840, as seen in FIG. 8B.

Figure 9A:
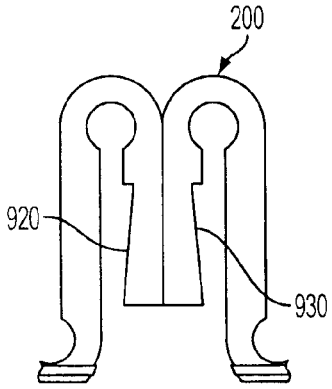
FIGS. 9A-9C illustrate a third embodiment of the clip.
Figure 9B:
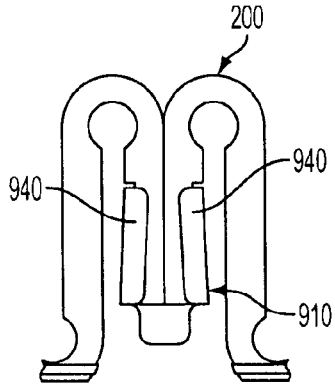
Figure 9C:
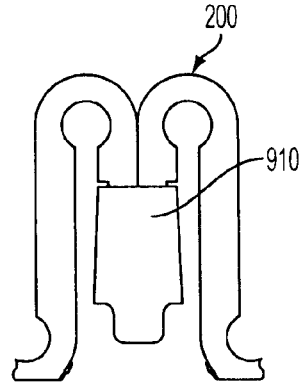

FIGS. 9A-9C illustrate yet another embodiment of the clip. The clip 910 is the same as the clip 810 of FIGS. 8A-8C except for its arms 940 taper (FIG. 9B). The tapered arms 940 of the clip 910 fit into corresponding tapered slots or notches 920 and 930 (FIG. 9A) at the terminal ends of the band's strap 200.

While particular embodiments have been chosen to illustrate the invention, it will be understood by those skilled in the art that various changes and modifications can be made therein without departing from the scope of the invention as defined in the appended claims.

What is claimed is:

1. A conductive band for an electrical connector, comprising of:

an elastic metal strap having first and second ends and an array of flexible members extending between said first and second ends, each of said first and second ends having a terminal lead, said terminal leads being aligned with one another without overlapping, and at least one of said terminal leads having a notch; and a clip coupled to said terminal leads of said first and second ends, said clip including a main body and at least one arm extending therefrom, said at least one of said arm engaging said notch of said at least one terminal lead of said elastic metal strap.

2. A conductive band for an electrical connector, comprising of:

an elastic metal strap having first and second ends and an array of flexible members extending between said first and second ends, each of said first and second ends having a terminal lead and at least one of said terminal leads including a notch; and a clip coupled to said terminal leads of said first and second ends, said clip including at least one arm extending from a main body thereof that is receivable in said notch.

3. A conductive band according to claim 2, wherein said flexible members are substantially U-shaped.

4. A conductive band according to claim 2, wherein each of said terminal leads includes a notch; and said clip is coupled to said notches.

5. A conductive band according to claim 2, wherein said clip includes a main body and a plurality of arms extending therefrom, and at least one of said arms engages at least one said terminal leads.

6. A conductive band according to claim 2, wherein said at least one arm is tapered with respect to said main body.

7. A conductive band according to claim 2, wherein said clip includes a ramp extending from one end of said main body.

8. A conductive band according to claim 2, wherein said strap includes a plurality of teeth extending from one edge thereof.

9. A conductive band according to claim 2, wherein said notch is tapered to correspond to a taper of said at least one arm.

10. A conductive band according to claim 9, wherein said flexible members are substantially U-shaped.

11. A conductive band for an electrical connector, comprising of:

an elastic metal strap having first and second ends and an array of flexible members extending between said first and second ends, each of said first and second ends having a terminal lead, and each of said terminal leads having a notch; and a clip coupled to said terminal leads of said first and second ends, said clip including a main body and a plurality of arms extending therefrom, at least one of said arms engaging at least one of said notches of said terminal leads of said elastic metal strap, whereby said terminal leads are aligned such that said notches mirror each other.

12. A conductive band according to claim 11, wherein said clip includes a ramp extending from one end thereof.

13. A conductive band according to claim 11, wherein said plurality of arms includes first and second sets of arms extending from said main body;

and said first and second sets of arms being spaced from one another

14. A conductive band according to claim 11, wherein each of said plurality of arms taper with respect to said main body of said clip; and each of said notches taper to correspond to said arms.

15. A conductive band according to claim 11, wherein a plurality of teeth extend from an edge of said elastic metal strap.

* * * * *